US005732941A

United States Patent [19]

Moll

[11] Patent Number: 5,732,941

[45] Date of Patent: Mar. 31, 1998

[54] CONTINUOUS FEED MOBILE UNIT

[76] Inventor: Richard J. Moll, 415 Constance Dr., Warminster, Pa. 18974

[21] Appl. No.: 630,666

[22] Filed: Apr. 10, 1996

[51] Int. Cl.[6] ..... B65H 5/00

[52] U.S. Cl. ..... 271/10.07; 271/35; 271/162

[58] Field of Search ..... 271/35, 162, 164, 271/10.06, 10.07

[56] References Cited

U.S. PATENT DOCUMENTS 1,948,362 2/1934 Staude ..... 271/35

3,908,983 9/1975 Long ..... 271/35

4,192,496 3/1980 Baselice et al. ..... 271/35 X 4,369,959 1/1983 Hornbuckle ..... 271/164 X 4,369,961 1/1983 Gopel et al. ..... 271/35 X

*Primary Examiner*—Boris Milef

[57] ABSTRACT

A continuous feed mobile unit which feeds sheets of paper one at a time, from the bottom of a stack onto endless moving belts, which transport the sheets to folder apparatus. Paper can be added to the top of the stack at any time, which does not interfere with feeding the sheets of paper from the bottom of the stack.

3 Claims, 2 Drawing Sheets

CONTINUOUS FEED MOBILE UNIT

BACKGROUND OF THE INVENTION

1. Field of the Invention

This invention relates to a mobile, continuous feed unit of the type which supplies sheets of paper from the bottom of a stack to another apparatus for folding.

2. Description of the Prior Art

When using folding apparatus such as the pocket folder shown in my prior U.S. Pat. No. 5,439,436 the sheets of paper to be folded are stacked onto a feeder table which is initially lowered for loading. The table is then raised into position for feeding the sheets of paper into the folder, which picks them off the top of the stack one at a time. While this is a satisfactory arrangement, it requires that the table be lowered for loading, which adds to the down time for the folder, and the number of sheets that can be loaded is limited. With this type of feeder table and the sporadic operation the benefits of continuously operating the folder are not realized. The continuous feeder of the invention permits paper sheets to be added at any time and can be used with a variety of folder apparatus.

SUMMARY OF THE INVENTION

It has now been found that a continuous feed unit is available that can be wheeled into position for use with a folder apparatus which feeds sheets of paper from the bottom of a stack, one at a time onto endless driven belts that transport the paper sheets to the folder, and which replaces the feeder table of the folder apparatus.

The principal object of the invention is to provide a mobile, continuous feed unit that feeds sheets of paper from the bottom of a stack of paper one at a time.

A further object of the invention is to provide a unit that can be adjusted to feed sheets of paper of different thickness.

A further object of the invention is to provide a unit that saves time and money in the operation of folding machines.

A further object of the invention is to provide a unit that can be used with a variety of different folding machines.

A further object of the invention is to provide a unit that is easy to use and is durable in service.

A further object of the invention is to provide a unit that can be loaded and reloaded without stopping the feeding operation.

Other objects and advantageous features of the invention will be apparent from the description and the claims.

DESCRIPTION OF THE DRAWINGS

The nature and characteristic features of the invention will be more readily understood from the following description taken in connection with the accompanying drawings forming part hereof in which.

It should of course be understood that the description and drawings herein are merely illustrative, and that various modifications and changes can be made in the structure disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
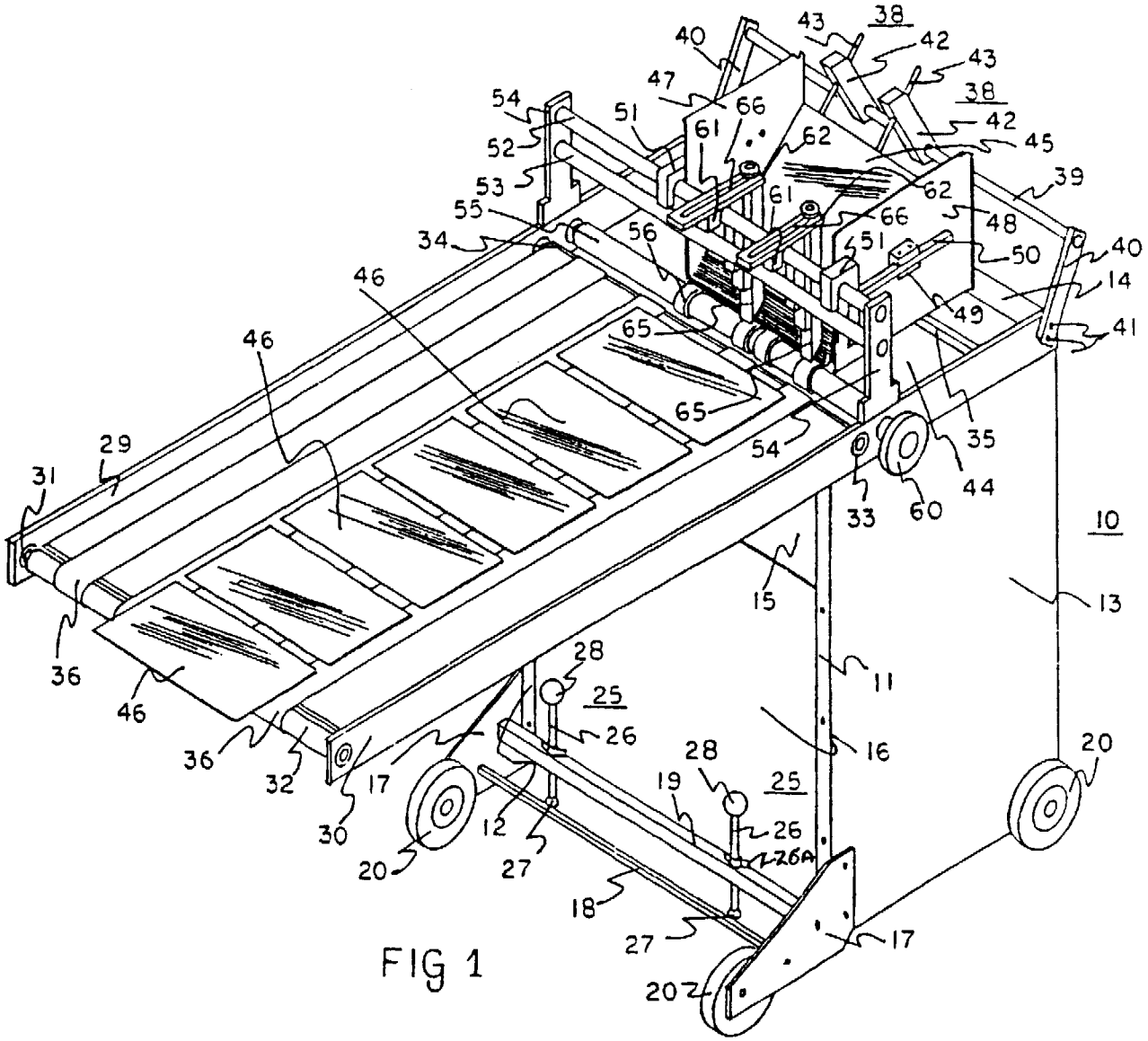
FIG. 1 is a perspective view of the continuous bottom feed mobile unit of the invention.

Referring now more particularly to FIG. 1 of the drawings, one embodiment of the continuous feed mobile unit 10 is therein illustrated. The unit 10 has a frame 11 which include right and left side panels, 12 and 13, which are connected by rear crossmember 14, and front upper panel 15. A bottom panel 16 also spans and connects the panels 12 and 13. Each panel 12 and 13 has a front plate 17 attached thereto, which plates are connected by crossmembers 18 and 19. Wheels 20 are mounted to the plates 17 and also to the rearward portion of side panels 12 and 13 to provide mobility to the unit 10.

The crossmember 19 is provided with two floor locking devices 25 of well known type, engaged therewith, which each include a vertically adjustable, threaded locking rod 26 which is provided with a wing nut 26A, with a stop piece 27 on the bottom for contact with the floor (not shown), and a knob 28 on the top of rod 26.

The panels 12 and 13 have horizontal bars 29 and 30 attached thereto by bolts (not shown), which extend forwardly from the panels 12 and 13, and are connected at the front by a round bar 31. The bar 31 carries a roller 32. The bars 29 and 30 in front of the panels 12 and 13 are connected by a round bar 33 which carries a roller 34 thereon. The bars 29 and 30 are connected at the rear by a crossmember 35.

The rollers 32 and 34 carry endless conveyor belts 35, four being illustrated, which are driven in conventional manner by a chain, sprockets and motor (not shown).

Paper stack rear supports 38 are provided, mounted to a rod 39 which is attached to plates 40, which are fastened to bars 29 and 30 by bolts 41. The rear paper stack supports 38, two in number being illustrated, include blocks 42 mounted to the rod 39, with shafts 43 extending therefrom down onto a transverse bed plate 44, which is connected to side panels 12 and 13 and receives a stack 45 of paper sheets 46.

The stack 45 has side plates 47 and 48 supporting it on each side.

The plates 47 and 48 each have a block 49 thereon, with bar 50 extending therefrom to support blocks 51 which are mounted to and carried by rods 52 and 53, which span the bars 29 and 30 and are attached to vertical plates 54 which are mounted to bars 29 and 30.

A feeder roller 55 is provided, mounted to and spanning bars 29 and 30 with a plurality of feeder belts 56 thereon, four being illustrated, and which engage the edges of the paper sheets 46 as they are fed one at a time, to be described. The feeder roller 55 is freely rotatable, and provided with a safety hand wheel 60 of well known type, which can be engaged to manually feed sheets of paper 46. The rods 51 and 52 also carry blocks 61, which are movable across the rods, with thumb screws (not shown) engaged therewith and with rods 51 and 52. The blocks 61 each have a plate 62 on the top which carry sheet separators 65, which are movable for adjustment vertically, and horizontally in slots 66 in plates 62.

The adjustment of the separators 65 accommodates different thickness of paper sheets 46, so that only one sheet at a time is presented to feeder belts 56.

Figure 2:
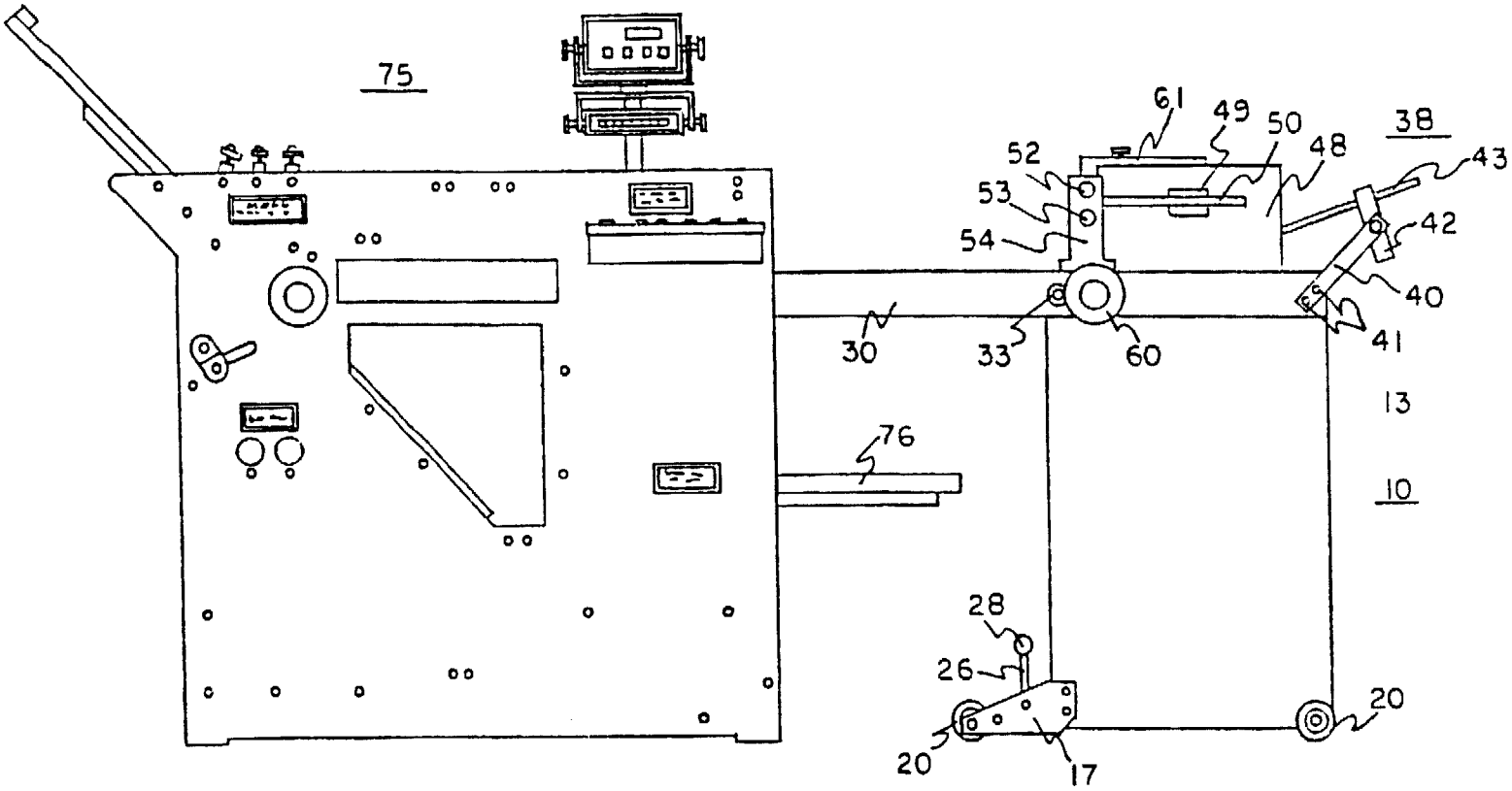
FIG. 2 is a side elevational view of the unit of the invention in place for feeding a pocket folding machine.

The mode of operation will now be pointed out. When it is desired to feed sheets of paper 46 to a folder such as pocket folder 75 of FIG. 2, the feeder table 76 thereof is lowered, and unit 10 moved into position. The motor (not shown) is activated and paper sheets 46 on conveyor belts 35 are transported to the folder 75 as seen in the FIGS.

The sheets 46 of paper in stack 45 are presented one at a time to feeder belts 56 by the sheet separators 65 from the bottom of the stack 45. It should be noted that additional sheets 46 can be loaded onto stack 45 at any time without interrupting the feeding operation. The sheets 46 from the stack 45 are deposited one at a time on the conveyor belts 35, on which they are conveyed to folder 75. It will thus be seen that a continuous bottom feed mobile unit has been provided with which the objects of the invention are attained.

I claim:

1. A continuous feed mobile unit for feeding sheets of paper one at a time from the bottom of a stack which comprises a frame;

plates attached to said frame;

wheel attached to said plates to provide mobility to said unit;

floor locking means attached to said frame for selective contact with a floor;

at least two separated parallel bars connected to said frame and extending horizontally therefrom;

at least two rotatable rollers spanning said horizontal bars;

a plurality of endless conveyor belts engaged with said rollers for conveying sheets of paper;

motor means driving said conveyor belts;

a bed plate on said frame supporting said paper stack;

rear stack support means mounted to said frame and engaged with said stack;

side plate stack means mounted to said frame and which support said stack on each side;

vertically adjustable sheet separator means engaged with said stack which permit feeding therefrom of one sheet at a time and;

at least manually rotatable feeder roller means spanning said horizontal bars and with said sheet separator means feeding said sheets of paper one at a time onto said conveyor belts.

2. A continuous feed mobile unit as described in claim 1 in which;

said sheet separator means are adjustable to accommodate different thickness of paper sheets.

3. A continuous feed mobile unit as defined in claim 1 in which;

said feeder roller means includes a plurality of feeder belts which engage said paper sheets and deposit them on said conveyor belts.

* * * * *